United States Patent [19]

Heller et al.

[11] 4,265,275

[45] May 5, 1981

[54] INTERNAL FIN TUBE HEAT EXCHANGER

[75] Inventors: László Heller; László Forgó; István Papp; János Bódás; Gyula Kovács, all of Budapest; Károly László, Jaszbereny, all of Hungary

[73] Assignee: Transelektro Magyar Villamossagi Kulkereskedelmi Vallalat, Budapest, Hungary

[21] Appl. No.: 52,797

[22] Filed: Jun. 28, 1979

Related U.S. Application Data

[63] Continuation of Ser. No. 811,903, Jun. 28, 1977, abandoned.

[30] Foreign Application Priority Data

Jun. 30, 1976 [HU] Hungary ..... EE 2429

[51] Int. Cl.[3] ..... F28B 3/02

[52] U.S. Cl. ..... 138/38; 165/179

[58] Field of Search ..... 138/38; 165/177, 179, 165/181

[56] References Cited

U.S. PATENT DOCUMENTS

| | | | |
|---|---|---|---|
| 1,691,979 | 11/1928 | Lochen | 138/38 |
| 2,079,144 | 5/1937 | Appa | 165/179 X |
| 2,107,031 | 2/1938 | Evans | 138/38 X |
| 2,378,344 | 6/1945 | Warrick | 138/38 X |
| 2,378,646 | 6/1945 | Manning | 165/179 X |
| 2,929,408 | 3/1960 | Westherwax et al. | 138/38 |
| 3,235,003 | 2/1966 | Smith | 138/38 X |
| 3,473,348 | 10/1969 | Boltum | 165/179 X |
| 3,783,938 | 1/1974 | Chartet | 138/38 X |
| 3,837,396 | 9/1974 | Newton | 138/38 X |
| 3,903,962 | 9/1975 | Newton | 138/38 X |

FOREIGN PATENT DOCUMENTS

| | | | |
|---|---|---|---|
| 837392 | 3/1952 | Fed. Rep. of Germany | 138/179 |
| 2029910 | 1/1971 | Fed. Rep. of Germany | 165/179 |
| 545181 | 6/1956 | Italy | 165/179 |
| 8320 | of 1884 | United Kingdom | 138/38 |

*Primary Examiner*—James E. Bryant, III

*Attorney, Agent, or Firm*—Young & Thompson

[57] ABSTRACT

An internal fin tube heat exchanger comprises a cylindrical tube having on its inside a continuous heat exchange member with a plurality of legs branched from a central longitudinal extending member. The heat exchange member can be metal strip cut with a plurality of ribs disposed at an acute angle thereto, so that when the member is pulled into the tube, the ribs do not resist movement in one direction but do resist reverse movement in the opposite direction, which opposite direction is also the direction of flow of the fluid within the tube. Thus the fluid does not dislodge the heat exchange member. The ribs can be cut in various patterns and the strip is rotated when being drawn into the tube so as to impart a twist thereto, thereby to position the ribs all about the periphery of the tube. The ribs can have feet thereon that extend either peripherally of the tube or longitudinally of the tube.

1 Claim, 6 Drawing Figures

INTERNAL FIN TUBE HEAT EXCHANGER

This is a continuation, of application Ser. No. 811,903, filed June 28, 1977 now abandoned.

It is known that heat exchangers consisting of bundles of tubes are often provided on the inner and outer surfaces of the tubes, with ribs for improving the heat transfer between the tubes and fluids flowing in or around the tubes. The ribs transfer the heat by heat conduction between the heat-carrying media and the inner and outer surfaces of the tubes. Naturally, efficient heat conduction between these ribs and the surfaces of the tubes is imperative.

Heat exchange constructions are known which are provided on the inner or outer or both surfaces with ribs; but the present invention is concerned only with such formations on the insides of the tubes.

Such known constructions comprise ribs formed on the inside of the tubes which run parallel with the longitudinal axis of the tube and which divide the internal cross section of the tube into several portions. The ribs are in good heat exchange contact with the material of the tubes. But the drawback of this construction is that the frictional resistance of the streaming media will also increase. Moreover, a large amount of material is consumed in providing these ribs. Furthermore, such ribbed tubes cannot be expanded, for example when being fitted to a header.

Another known construction comprises the provision of wires within the tubes that are soldered onto the inner surface of the tubes in the form of bristles or helical springs.

Also, internal ribs made of wire or narrow metal strips are known, which are disposed lengthwise in the tube and which, because of their resilience and their shape, fit tightly against the inner surfaces of the tubes. In order to achieve suitable heat transfer contact with the tubes, these inserts can be soldered at their contact points to the tubes.

According to the present invention, the ribs in the tubes are formed in such a manner that clogging of the tubes is avoided because the ribs move inwardly with an elastic deformation should clogging tend to occur. At the same time, however, the ribs can not be moved in the direction of fluid flow through the tubes, because the ribs resist their own movement in this direction.

Also according to the present invention, the ribs have good heat exchange contact with the tubes, without the need for soldering. The ribs can be drawn into the tube in one direction with ease but cannot be substantially moved in the opposite direction. The ribs can thus be easily manufactured by mass production techniques.

The present invention is also adaptable for tubes that are not of uniformly circular cross section, and that are not entirely straight, or whose diameter is not constant.

The ribs of the present invention are preferably integral with narrow metal strips, whose straightness, width and other characteristics need not necessarily be entirely uniform. Thus, whether the tubes are irregular or the strips are irregular, according to the present invention the strips will nevertheless contact the inner surface of the tubes with good heat exchange contact.

Accordingly, it is an object of the present invention to provide an internal fin tube heat exchanger which has good heat transfer characteristics despite irregularities in the tube and/or fin.

Another object of the present invention is the provision of such a heat exchanger, in which the fin cannot be displaced by the streaming media, despite the absence of soldering of the fin to the tube.

Still another object of the present invention is the provision of such a heat exchanger, which avoids clogging.

Finally, it is an object of the present invention to provide such a heat exchanger, which will be relatively simple and inexpensive to manufacture, easy to maintain, and rugged and durable in use.

Other objects, features and advantages of the present invention will become apparent from a consideration of the following description, taken in connection with the accompanying drawing, in which.

Figure 1:
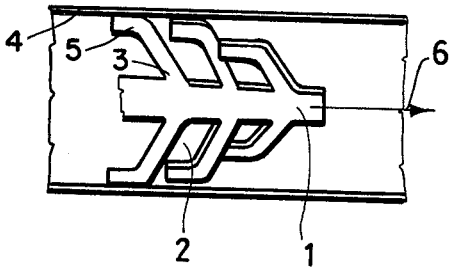
FIG. 1 is a fragmentary cross-sectional view of a first embodiment of internal fin tube heat exchanger according to the present invention, viewed in a plane that includes the axis of the tube.

Referring now to the drawings in greater detail, and first to the embodiment of FIG. 1, there is shown an internal fin tube heat exchanger according to the present invention, comprising an elongated continuous fin 1, in the form of a narrow metal strip that has cutaway portions as shown at 2 whose sides are inclined away from the direction indicated by the arrow 6. Cutaway portions 2 define between them ribs 3 that bear against the inner surface of the tube 4 with good heat exchange contact. Feet 5 at the ends of ribs 3 extend parallel to tube 4 and increase the contact area and hence the heat transfer area between ribs 3 and tube 4.

Figure 2:
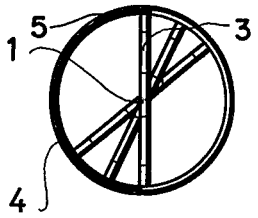
FIG. 2 is a cross-sectional view of the heat exchanger of FIG. 1, in a plane perpendicular to the axis of the tube.

To make the device of FIG. 1, the strip 1 is cut out to the shape shown, and then it is drawn into and through the tube 4 in the direction of the arrow 6. Strip 1 is rotated during insertion, so that the strip takes on a twisted configuration and the ribs 3 take on the spiral arrangement visible by comparison of FIGS. 1 and 2.

Figure 3:
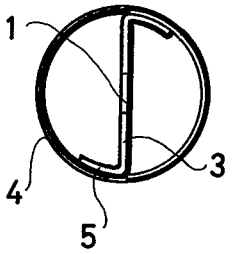
FIGS. 3–5 are views similar to FIG. 2, but of modified forms of the invention.

A modified form of the invention is shown in FIG. 3, in which the strip 1*a* has ribs 3*a* thereon which contact the tube 4*a* in feet 5*a* which are bent in the direction of the internal periphery of tube 4*a*.

Figure 4:
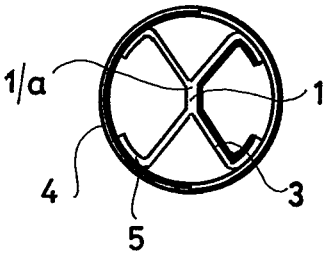

FIG. 4 shows another embodiment, in which two strips 1*b* and 1*b'* are provided and which are identical to each other and are assembled in mirror image relationship as shown in FIG. 4. Thus, not only is the total exposed surface area of the ribs increased, but also the number of heat transfer feet 5*b* is doubled.

Figure 5:
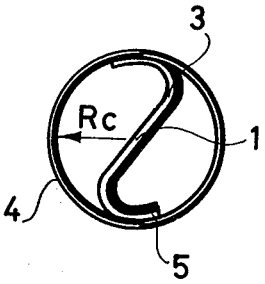

FIG. 5 shows still another embodiment, in which the rib 1*c* of metal strip has ribs 3*c* thereon whose radius of curvature $R_b$ of the foot 5*c* exceeds the radius of curvature $R_c$ of the tube in the undeformed condition of the strip, whereby when the strip is inserted, the feet 5*c* are pressed resiliently against the inner surface of the tube 4*c*.

Figure 6:
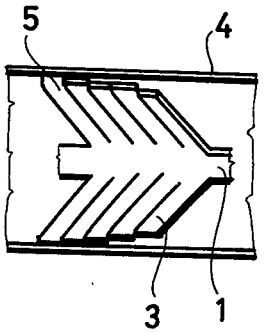
FIG. 6 is a view similar to FIG. 1, but of a modified form of the invention.

FIG. 6 shows a further embodiment in which the strip 1*d* has ribs 3*d* that are separated from each other by only thin slits therebetween, and hence with no waste of material. The resilience of the metal of the ribs 3*d* ensures that the feet 5*d* constituted by their outer ends will be applied in good heat exchange relationship against the interior of tube 4*d*.

From a consideration of the foregoing disclosure, therefore, it will be evident that all of the initially recited objects of the present invention have been achieved.

Although the present invention has been described and illustrated in connection with preferred embodiments, it is to be understood that modifications and variations can be resorted to without departing from the spirit of the invention, as those skilled in this art will readily understand. Such modifications and variations are considered to be within the purview and scope of the present invention as defined by the appended claims.

We claim:

1. An internal fin tube heat exchanger, comprising a cylindrical tube, and inside the tube a resilient metal strip that is cut to provide a central strip and a plurality of ribs in the form of strips extending from both side edges of said central strip at an acute angle to the length of the central strip, the free ends of the ribs bearing resiliently against the inner surface of the tube, said strip being twisted whereby said ribs contact said tube in a helical pattern, said ribs terminating in feet that are parallel to said central strip and that extend from the ends of said ribs in the same axial direction as the ribs are inclined from the central strip and that are in heat exchange contact with the inner surface of said tube, said ribs being cut from said strip with space between them, each said rib and its associated said foot being coplanar and being disposed substantially in a radial plane of said cylindrical tube.

* * * * *